US008447211B2

(12) United States Patent
Takahashi et al.

(10) Patent No.: US 8,447,211 B2
(45) Date of Patent: May 21, 2013

(54) IMAGE FORMING APPARATUS, IMAGE FIXING DEVICE AND IMAGE FORMING SYSTEM EQUIPPED THEREWITH

(75) Inventors: Atsushi Takahashi, Akishima (JP); Masami Maruko, Hachioji (JP); Youbao Peng, Hino (JP); Yoshihito Sasamoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 228 days.

(21) Appl. No.: 12/955,691

(22) Filed: Nov. 29, 2010

(65) Prior Publication Data

US 2011/0129253 A1 Jun. 2, 2011

(30) Foreign Application Priority Data

Dec. 2, 2009 (JP) ..... 2009-274721

(51) Int. Cl.
*G03G 15/16* (2006.01)

(52) U.S. Cl.
USPC ..... 399/122; 399/328

(58) Field of Classification Search
USPC ..... 399/43, 122, 322, 324, 328
See application file for complete search history.

(56) References Cited

U.S. PATENT DOCUMENTS

| | | | | |
|---|---|---|---|---|
| 5,323,216 | A * | 6/1994 | Mahoney | 399/45 |
| 2002/0016400 | A1* | 2/2002 | Kiyomura et al. | 524/430 |
| 2005/0135846 | A1* | 6/2005 | Russel et al. | 399/328 |
| 2007/0217803 | A1* | 9/2007 | Nakayama | 399/68 |
| 2008/0145115 | A1* | 6/2008 | Spence et al. | 399/322 |

FOREIGN PATENT DOCUMENTS

| | | |
|---|---|---|
| JP | 2006-317881 | 11/2006 |
| JP | 2007-34068 | 2/2007 |
| JP | 2008-225276 | 9/2008 |
| JP | 2008-298925 | 12/2008 |

* cited by examiner

*Primary Examiner* — David Gray
*Assistant Examiner* — Thomas Giampaolo, II
(74) *Attorney, Agent, or Firm* — Finnegan, Henderson, Farabow, Garrett & Dunner, L.L.P.

(57) ABSTRACT

An image forming apparatus includes: an image forming section which transfers a toner image in accordance with image data onto a recording sheet; a first fixing device having a first fixing roller, which fixes the toner image onto the recording sheet with heat; a second fixing device having a second fixing roller, which further applies heat to the recording sheet that has been fixed by the first fixing device; a second fixing roller surface roughness prevention mechanism which prevents a roughness on a surface of the second fixing roller that has been generated due to side ends of the recording sheet being brought into contact with the surface of the second fixing roller; and a controller which controls the image forming section, the first and second fixing devices and the second fixing roller surface roughness prevention mechanism.

11 Claims, 10 Drawing Sheets

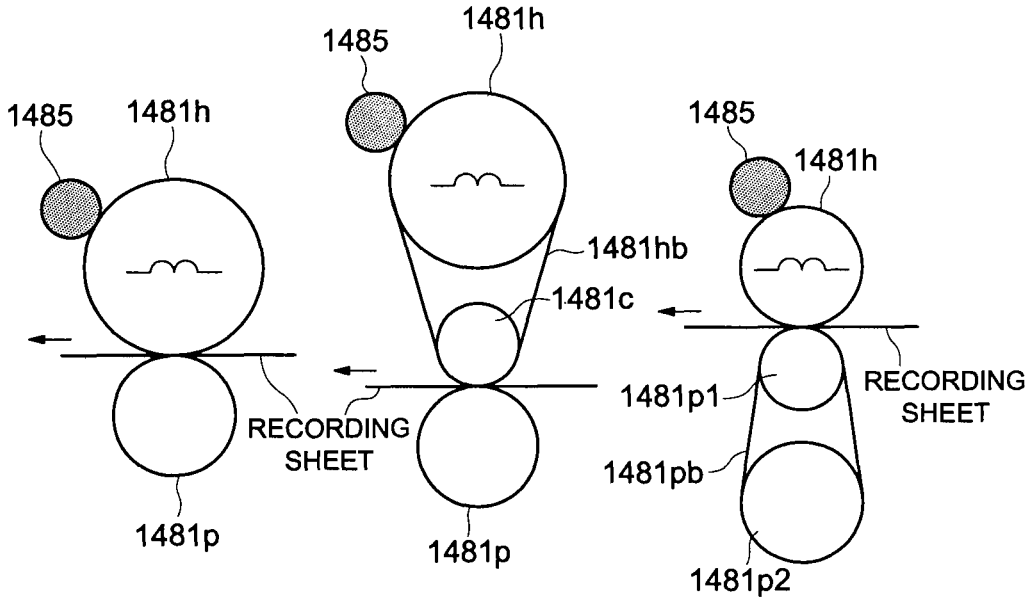
FIG. 10A FIG. 10B FIG. 10C
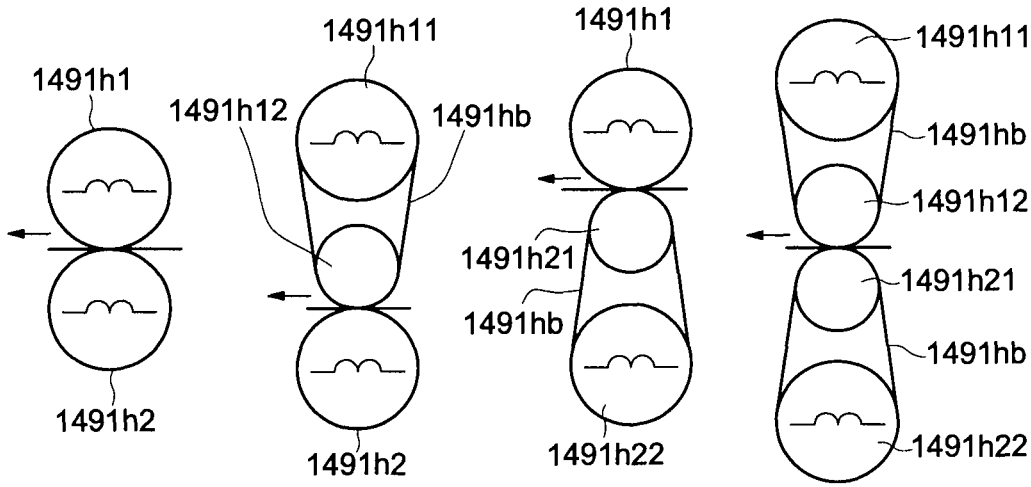
FIG. 10D FIG. 10F
FIG. 10E FIG. 10G

IMAGE FORMING APPARATUS, IMAGE FIXING DEVICE AND IMAGE FORMING SYSTEM EQUIPPED THEREWITH

This application is based on Japanese Patent Application No. 2009-274721 filed on Dec. 2, 2009, which is incorporated hereinto by reference.

BACKGROUND OF THE INVENTION

The present invention relates to an image forming apparatus for forming a toner image using the electrophotographic process, an image fixing device for fixing the toner image, and an image forming system equipped with the image forming apparatus and image fixing device, particularly to a technique for preventing the fixing roller surface from being roughened.

In an image forming apparatus using the electrophotographic process, a toner image is formed on an image carrier of a rotating photoreceptor drum and photoreceptor belt, and the formed toner image is directly or indirectly transferred onto a recording sheet The image is further fixed so as to form an image thereon.

In the aforementioned image forming process, the toner image transferred electrostatically onto the recording sheet is fixed on the recording sheet in a stable state by heat and pressure of a fixing roller. Incidentally, image formation (fixing) is repeated using the recording sheet of one and the same size, and side ends of the recording sheet is brought in contact with the same positions of the fixing roller surface. This may cause a scratch or abrasion on the fixing roller surface, with the result that the service life of the fixing roller will be reduced.

Further, uniform fixing will be interfered by such a scratch and abrasion, and image quality will be deteriorated. Such a problem arises conspicuously when a transfer sheet of a certain size has been repeatedly used to produce a scratch or abrasion on the fixing roller, and a recording sheet having a size greater than that of the transfer sheet is used.

The following patent documents have been proposed in an effort to avoid such a scratch or abrasion (hereinafter referred to as "roughness") on the fixing roller surface.

In the Unexamined Japanese Patent Application Publication No. 2008-298925, the end of the recording sheet is sandwiched on the upstream side of the fixing device, whereby the thickness of the end is reduced. This arrangement reduces the amount of the fixing roller surface from being scratched by the end of the recording sheet sandwiched and reduced in thickness.

The Unexamined Japanese Patent Application Publication No. 2006-317881 discloses a technique of reducing the level of roughness on the surface by introducing an abrasive agent for polishing the surface of the fixing belt.

The Unexamined Japanese Patent Application Publication No. 2008-225276 provides the fixing roller or fixing belt surface with a recessed section for reducing the pressure.

In the Unexamined Japanese Patent Application Publication No. 2007-34068, the contact member of a belt is arranged in a fixing device constituting an upper belt and a lower roller to ensure that the surface roughness of the lower roller is greater than that of the upper belt.

Incidentally, an image forming apparatus has been proposed in recent years wherein a second fixing device is provided on the downstream side of the fixing device to re-melt the fixed toner, whereby the level of glossiness is upgraded. This second fixing device is intended to upgrade the level of glossiness of the toner image. Accordingly, the proposals given in the aforementioned patent documents cannot be used directly. Further, this proposal has failed to introduce any technique suited to the second fixing device, capable of reducing the level of roughness on a fixing roller surface.

Further, even when image formation (fixing) is repeated using the recording sheets of the same size, the conveying conditions differ according to the type of the sheets. This may result in a slight difference in the positions to be passed through by sheets between the first fixing roller and the second fixing roller. Thus, although there may be no problem with the first fixing roller, the roughness of the surface on the part of the second fixing roller may interfere with the uniform glossiness.

SUMMARY OF THE INVENTION (1). To achieve at least one of the abovementioned objects, an image forming apparatus reflecting one aspect of the present invention comprises an image forming apparatus including: an image forming section for transferring a toner image in response to the image data; a first fixing device containing a first fixing roller for fixing the aforementioned toner image to the recording sheet by heat; a second fixing device containing a second fixing roller for applying heat to the recording sheet with the image having been fixed by the first fixing device; a second fixing roller surface roughness prevention mechanism that prevents roughness on the surface by bringing side ends of the transfer sheet into contact with the surface of the second fixing roller; and a controller for controlling above various components.

(2). The image forming apparatus of the aforementioned aspect (1) wherein the controller allows the second fixing roller surface roughness prevention mechanism to be operated when a prescribed number of the recording sheets having the same size in the image forming operation has been reached.

BRIEF DESCRIPTION OF THE DRAWINGS

FIGS. 10A through 10G are schematic diagrams showing the approximate structure of an embodiment of the present invention.

DETAILED DESCRIPTION OF THE PREFERRED EMBODIMENT

The following describes the details of the embodiments for implementing the image forming apparatus of the present invention, with reference to the drawings.

[Structure of Image Forming Apparatus 100]

Figure 1:
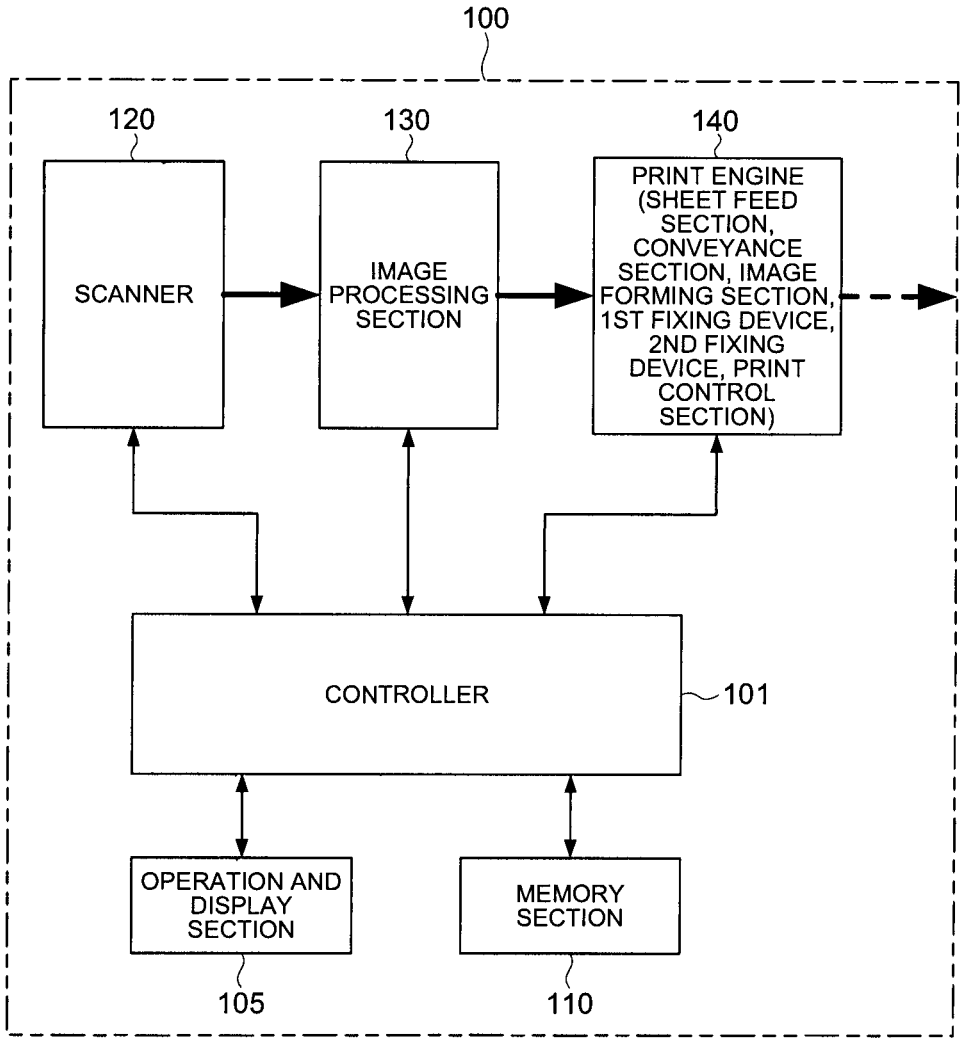
FIG. 1 is a schematic diagram representing the approximate structure of an embodiment of the present invention.

Referring to FIG. 1 and subsequent Figures, the following describes the structure of the image forming apparatus 100 using the electrophotographic process in the first embodiment. It should be noted that the image forming apparatus 100 is a known apparatus, and the following omits the description on the general information not directly related to the operations and controls characteristic of this embodiment.

The image forming apparatus 100 of FIG. 1 includes a controller 101 for controlling various components, an operation and display section 105 that is used by an operator to perform various input operations and which provides various forms of indications, a memory section 110 for storing job data and various forms of data, a scanner 120 for reading a document and generating image data, an image processing section 130 for implementing a prescribed image processing on the image data for image formation and a print engine 140 for forming an image on sheets in response to image data.

The controller 101 is provided with a CPU (Central Processing Unit), ROM (Read Only Memory), RAM (Random Access Memory) and others that are not illustrated. Using a prescribed area of the RAM as a work area, the CPU executes various forms of programs stored in the ROM and provides administrative control of each component of the image forming apparatus 100. The controller 101 controls the process of fixing roller surface roughness prevention shown in the flow chart, as will be described later.

The operation and display section 105 includes input devices such as a keyboard, mouse and touch panel, and sends the various forms of inputted instruction signals to the controller 101. Further, the operation and display section 105 includes display devices such as an LCD (Liquid Crystal Display) and CRT (Cathode Ray Tube), and displays various forms of image data inputted from the controller 101. This operation and display section can have an operation section apart from the display section. However, in the following description of the embodiments, the operation and display section 105 is assumed as a touch panel type operation and display section 105, because a touch panel type wherein the displayed icon or key (hereinafter referred to as "key") is pressed is commonly employed.

The memory section 110 is a storage device such as an HDD (Hard Disc Drive) or flash memory capable of freely writing, deleting, and reading the data. It can be a permanently fixed device or a removable device. This memory section 110 stores the job data including one or more than one registered job (including the jobs already processed, currently being processed, and not yet processed). The memory section 110 also stores the data required to control the fixing roller surface roughness prevention.

The print engine 140 is an image forming section and printing device using an electrophotographic process or other various forms of processes. In a photocopier, printer and facsimile devices, the print engine 140 forms an image on a prescribed sheet of paper and outputs the resulting image. The print engine 140 includes a first fixing device for ensuring that the toner image transferred onto the recording sheet is fixed onto a recording sheet in the stable state by heat and pressure provided by the first fixing roller through the structure shown in FIG. 3 and subsequent Figures to be described later; and a second fixing device for allowing further heat and pressure to be applied by the fixing roller to the recording sheet to which the toner image is fixed by the first fixing device.

The second fixing device applies further heat and pressure to the recording sheet to which the toner image has been fixed by the first fixing device, whereby more stable fixing is achieved, and the wax component contained in the toner is re-melted so as to enhance the gloss on the toner image surface.

In the illustrated example, the image forming apparatus 100 can be configured to communicate with terminal equipment such as an external PC through a communication means which is not illustrated. In this case, the communication means is assumed to represents a LAN (Local Area Network) or WAN (Wide Area Network) for example. It can further include various forms of communication lines such as a telephone line, ISDN (Integrated Services Digital Network), ADSL (Asymmetric Digital Subscriber Line), mobile communication network, communication satellite line, CATV (Cable TeleVision) line, optical communication line, and radio communication line.

[Structure of Image Forming System]

Figure 2:
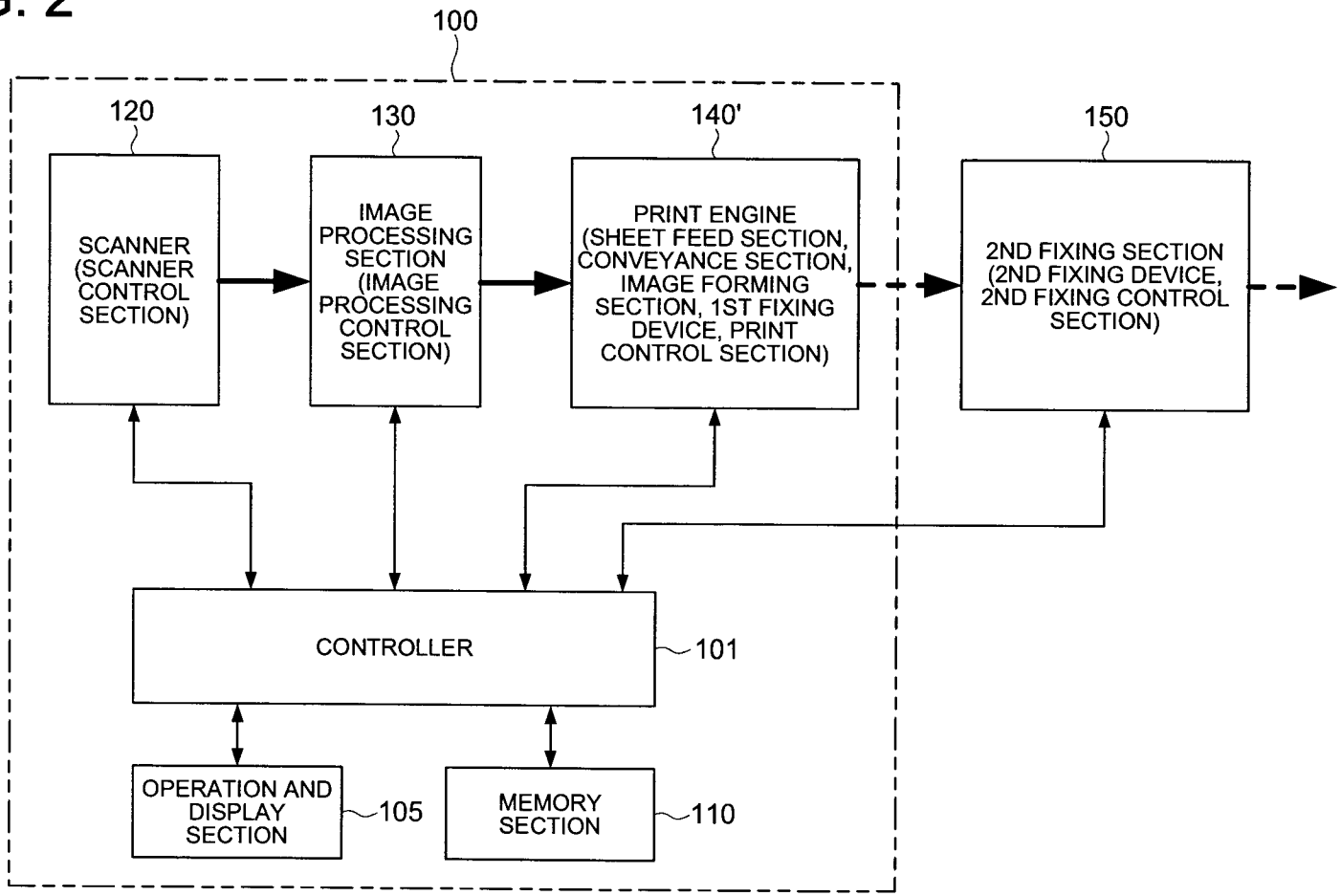
FIG. 2 is a schematic diagram representing the approximate structure of an embodiment of the present invention.

FIG. 1 shows the second fixing device wherein the second fixing device together with the first fixing device is incorporated in the print engine 140. However, the present invention is not restricted thereto. For example, as shown in FIG. 2, in contrast to the image forming apparatus 100 with the first fixing device built in the print engine 140', the second image fixing device 150 can be mounted as an external optional device. In this case, general image formation can be achieved only by the image forming apparatus 100. If the second image fixing device 150 is mounted, a further stabilized fixing operation can be performed, and the toner image surface can be made more glossy and bright by re-melting of the wax component contained in the toner. In this case, the image forming apparatus 100 and the second image fixing device 150 constitute the image forming system.

[Structure of Print Engine 140]

Figure 3:
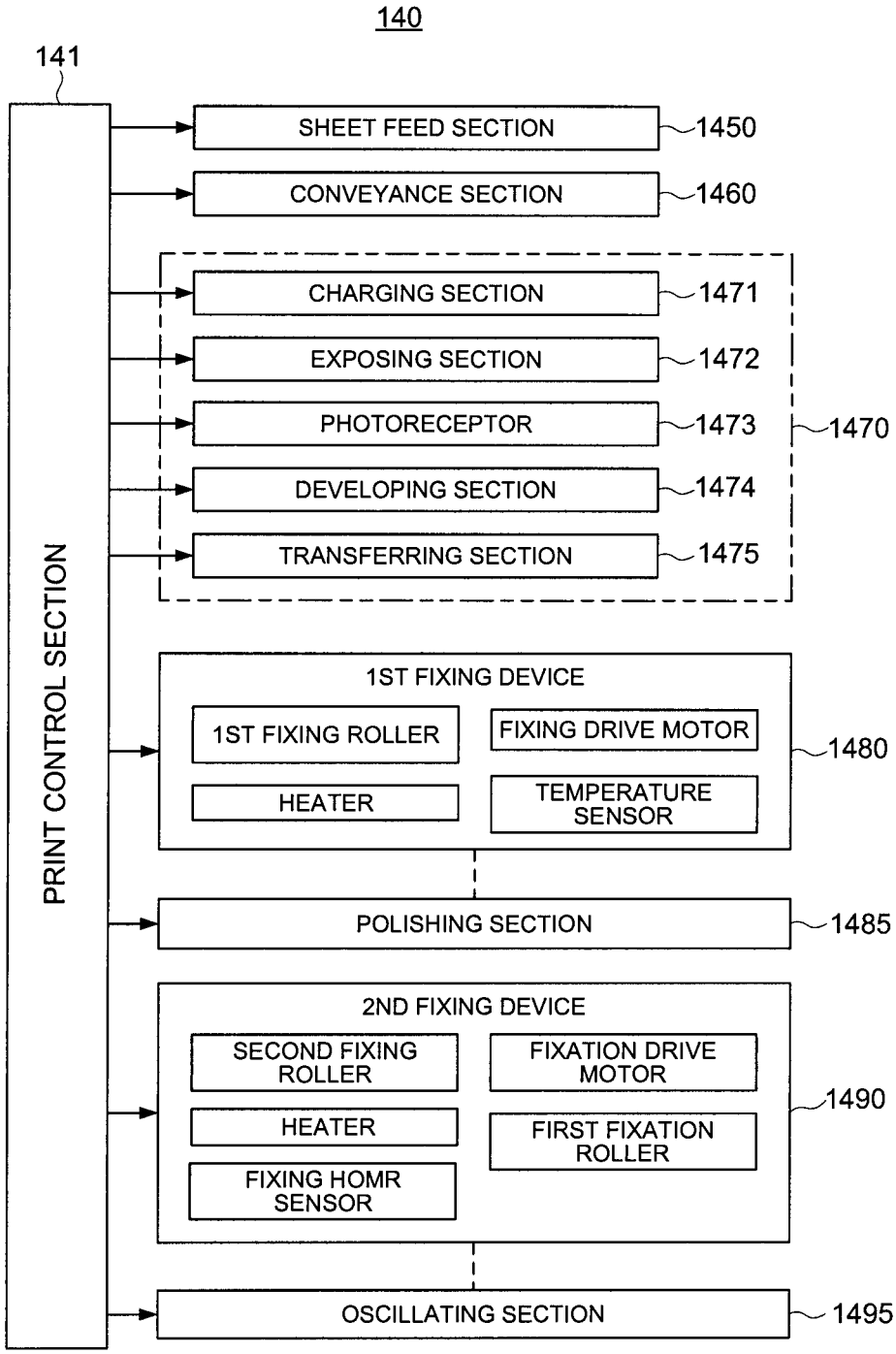
FIG. 3 is a schematic diagram representing the approximate structure of an embodiment of the present invention.
Figure 5:
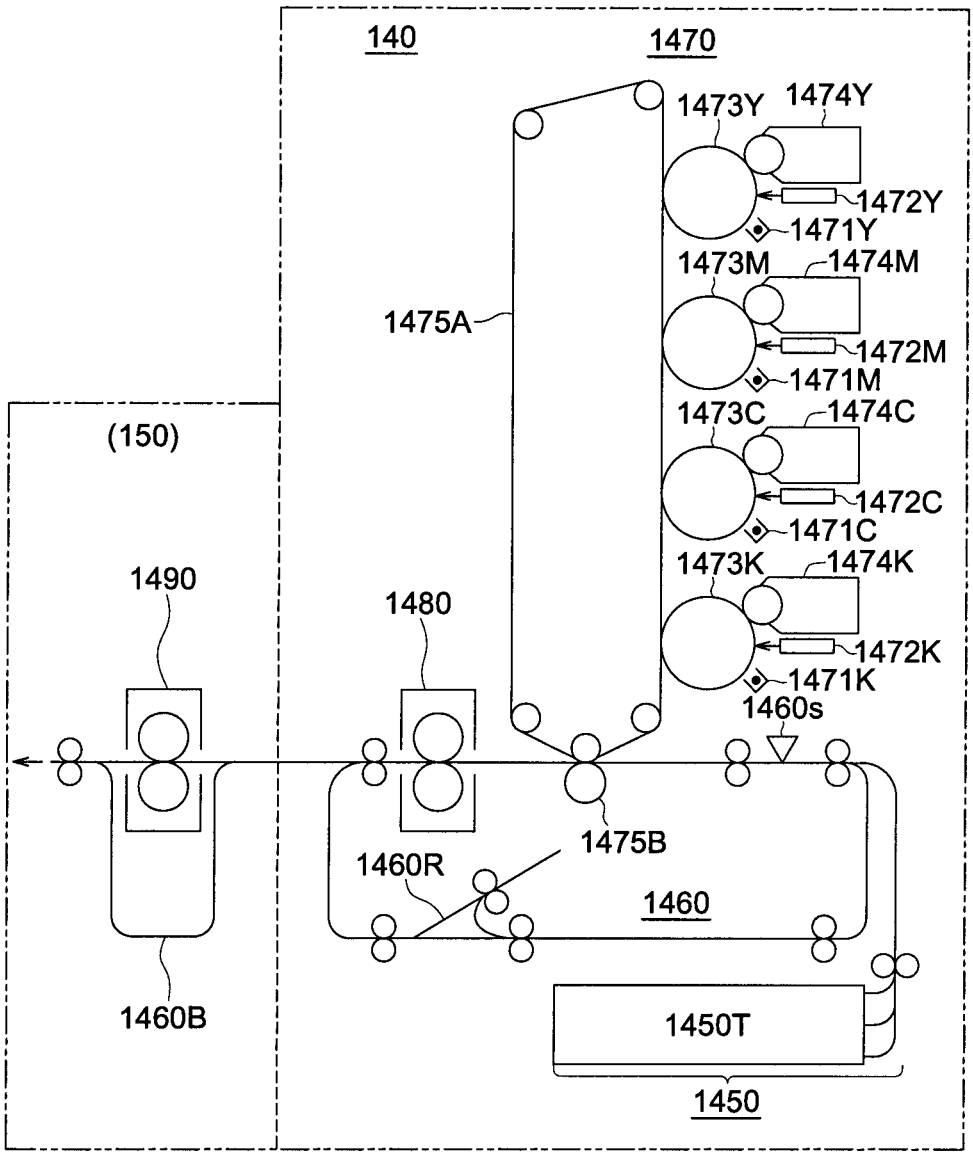
FIG. 5 is a schematic diagram representing the approximate structure of an embodiment of the present invention.

Referring to the block diagram of FIG. 3 and the cross sectional view of FIG. 5, the following describes the structure of the print engine 140 inside the image forming apparatus 100 as the first embodiment shown in FIG. 1. It should be noted that the print engine 140 is a known apparatus, and the following omits the description on the general information not directly related to the operations and controls characteristic of this embodiment.

FIG. 3 also shows the basic structure of a one-color component. The color image forming apparatus is configured in such a way that each section corresponds to each color, as shown in FIG. 5.

The print engine 140 of the present embodiment includes a print control section 141 including a CPU (Central Processing Unit) as a control means for controlling each section related to image formation, a sheet feed section 1450 for feeding the recording sheet stored in the sheet feed tray 1450T, a conveyance section 1460 for conveying the recording sheet fed out by the sheet feed section 1450 at a prescribed conveyance speed with the timing of image formation adjusted by the sensor 1460*s*, an image forming section 1470 for forming a toner image on the photoreceptor such as a rotating photoreceptor drum or photoreceptor belt and for transferring this image electrostatically onto the recording sheet directly or indirectly so that an image is formed, a first fixing device 1480 for ensuring that the toner image transferred onto the recording sheet is fixed on the recording sheet in a stable state by the heat and pressure of the fixing roller, and a second fixing device 1490 for ensuring that the toner image transferred onto the recording sheet is fixed on the recording sheet in a stable state by the heat and pressure of the fixing roller.

In response to the control program of the controller 101 and image forming apparatus 100, the print control section 141 controls each component of the print engine 140, and provides various forms of adjustment and control, whereby the print engine 140 is placed under administrative control.

The sheet feed section 1450 ensures that the recording sheets placed on one or more than one sheet feed tray 1450T are fed to the position for image formation by the sheet feed roller. The conveyance section 1460 is a conveyance means for conveying at a prescribed conveyance speed the recording sheets fed out of the sheet feed section 1450, and is provided with a registration roller, other various types of conveyance rollers, and a conveyance belt. Further, a conveyance sensor 1460*s* such as a leading edge detection sensor for detecting the edge of the recording sheet is mounted at a prescribed position of each section of the conveyance section 1460.

Figure 6:
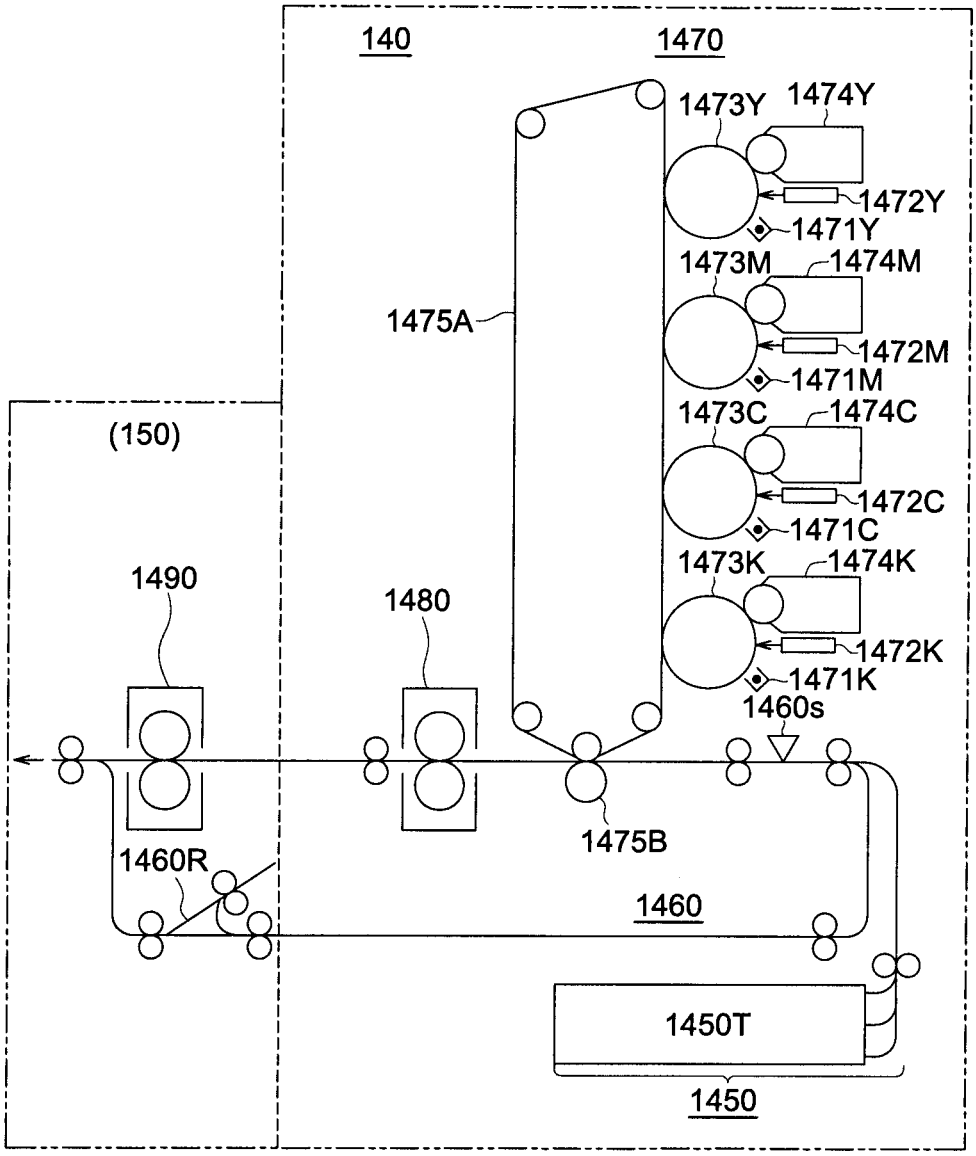
FIG. 6 is a schematic diagram representing the approximate structure of an embodiment of the present invention.

Incidentally, the conveyance section 1460 incorporates a reverse conveyance path 1460R based on the switch-back system for duplex image formation. The recording sheet can be circulated from the output side of the first fixing device 1480 through the reverse conveyance path 1460R, as shown in FIG. 5. Further, the recording sheet can be circulated from the output side of the second fixing device 1490 through the reverse conveyance path 1460R, as shown in FIG. 6. In the vicinity of the second fixing device 1490, the bypass path 1460B for detouring around the second fixing device 1490 is provided as a detour conveyance path, as shown in FIG. 5.

The image forming section 1470 is provided with charging sections 1471 (1471Y through K) for charging the photoreceptor with a prescribed voltage, exposing sections 1472 (1472Y through K) for forming an electrostatic latent image by exposing the charged photoreceptor in response to image data, and by changing the charged voltage, photoreceptors 1473 (1473Y through K) as image carriers for forming an electrostatic latent image on the surface through the aforementioned process of charging and exposure, and for converting this electrostatic latent image into a toner image, developing sections 1474 (1474Y through K) for attaching toner to the electrostatic latent image formed on the surface of the photoreceptor 1473 so that a toner image is formed by development and a transferring section 1475 for transferring electrostatically onto the recording sheet the toner image formed on the surface of the photoreceptor 1473.

The charging section 1471, exposing section 1472, photoreceptor 1473, and developing section 1474 can be configured independently of each other for each of the colors Y, M, C and K used for image formation, as shown in FIG. 5.

In the case of the color image forming apparatus of FIG. 5, the transferring section 1475 can be provided with an intermediate transfer member 1475A for superimposing the toner images of the colors Y, M, C, and K; and a secondary transferring section 1475B for transferring the superimposed toner image onto the recording sheet.

The toner image transferred onto the recording sheet by the transferring section 1475 is fixed in a stable state by the heat and pressure of the two fixing devices, a first fixing device 1480 and a second fixing device 1490.

A polishing section 1485 equipped with a polishing member such as a polishing sheet or polishing roller is provided as a first fixing roller surface roughness prevention mechanism, close to the first fixing roller surface of the first fixing device 1480. The first fixing roller surface is polished by the polishing section 1485 equipped with the polishing section such as a polishing sheet or polishing roller, so as to minimize the surface roughened by scratches or abrasions caused by the edge of the recording sheet.

In the vicinity of the second fixing device 1490, an oscillating section 1495 is arranged as a second fixing roller surface roughness prevention mechanism. The second fixing device 1490 can be oscillated in the axial direction of the fixing roller by the oscillating section 1495. The second fixing roller is oscillated in the axial direction by the oscillating section 1495 so as to minimize concentration of the roughness on the surface due to scratches or abrasions caused by the edge of the recording sheet.

Figure 4:
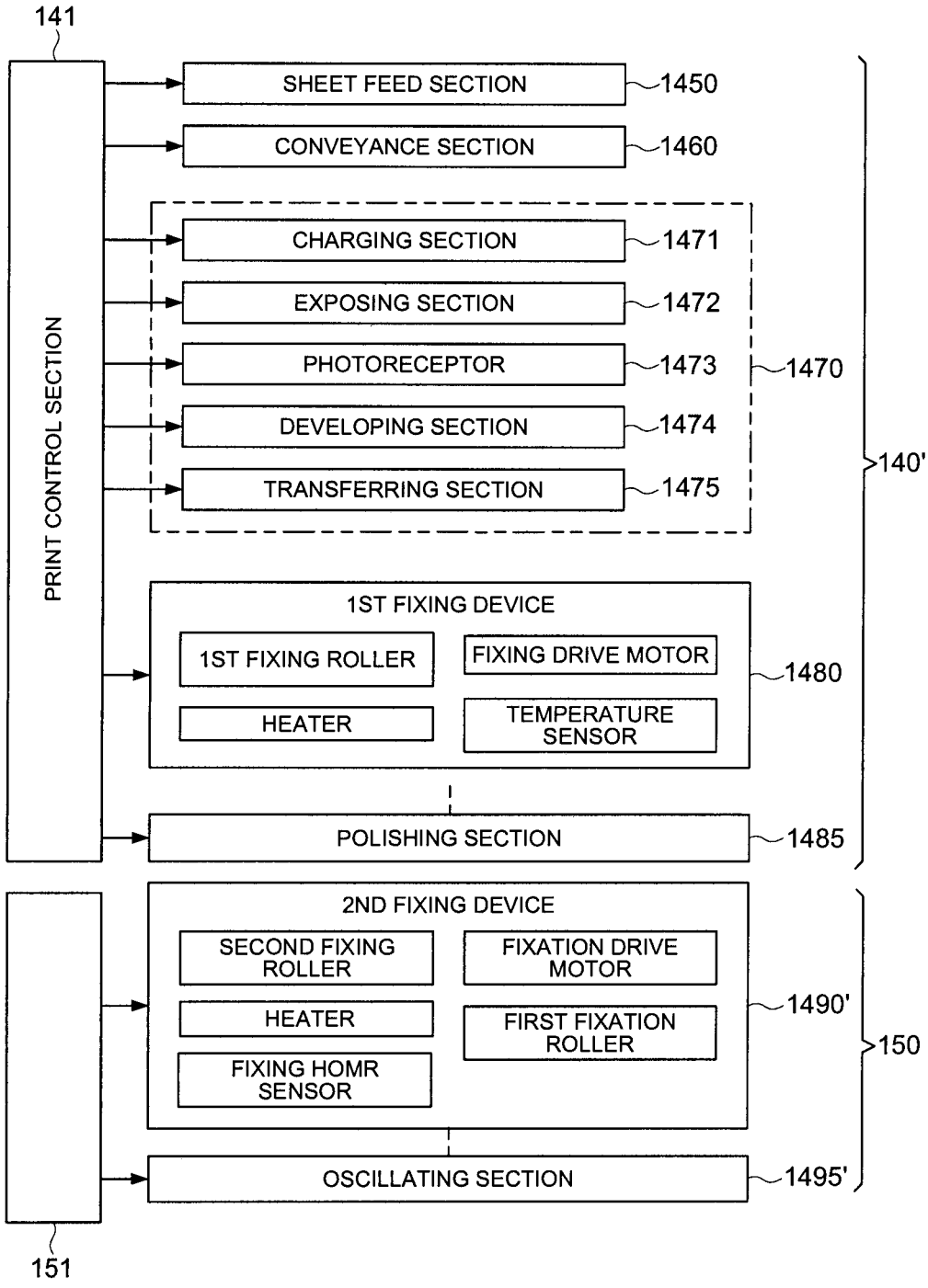
FIG. 4 is a schematic diagram representing the approximate structure of an embodiment of the present invention.

FIG. 3 shows the second fixing device wherein the first fixing device 1480 and second fixing device 1490 are built in the print engine 140. However, the present invention is not restricted thereto. For example, it is possible to provide a second image fixing device 150 equipped with a second fixing device 1490' as an external optional device, in response to the image forming system of FIG. 2, as shown in FIG. 4, in contrast to the image forming apparatus 100 wherein the print engine 140' incorporates the first fixing device 1480.

In this case, the second image fixing device 150 incorporates an oscillating section 1495' as a second fixing roller surface roughness prevention mechanism. It is further provided with a second fixing controller 151, wherever required. Instead of the second fixing controller 151 being provided, it is also possible to arrange such a configuration that control is provided by the print control section 141 or controller 101.

[Structure of the Fixing Roller Surface Roughness Prevention Mechanism of the First Fixing Device 1480 and Second Fixing Device 1490]

Figure 7A:
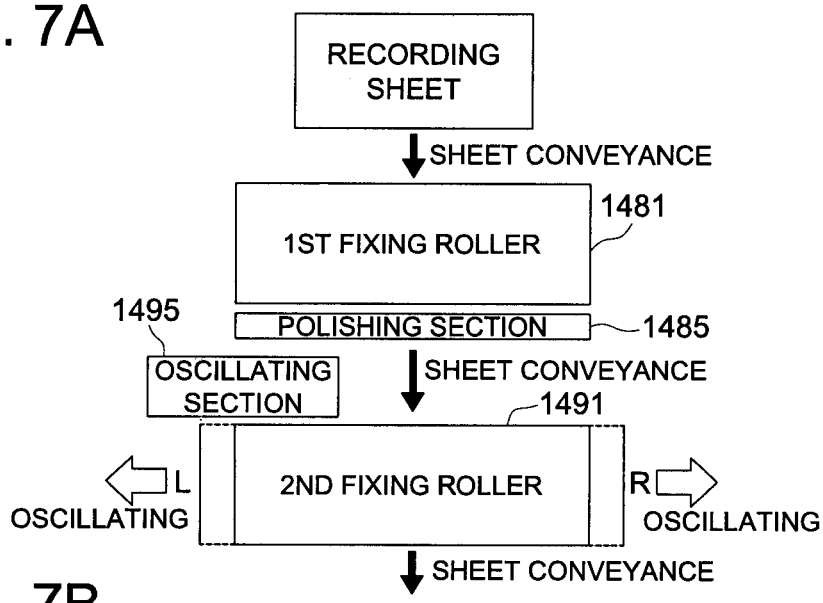
FIGS. 7A through 7C are explanatory diagrams showing the state of a fixing device in an embodiment of the present invention.
Figure 7B:
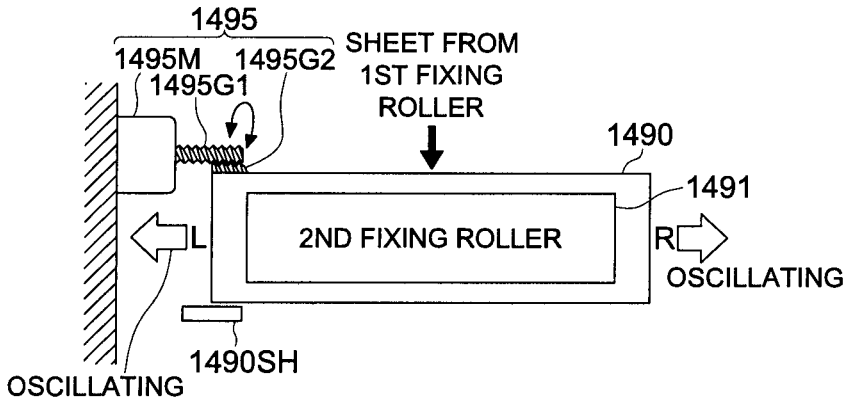
Figure 7C:
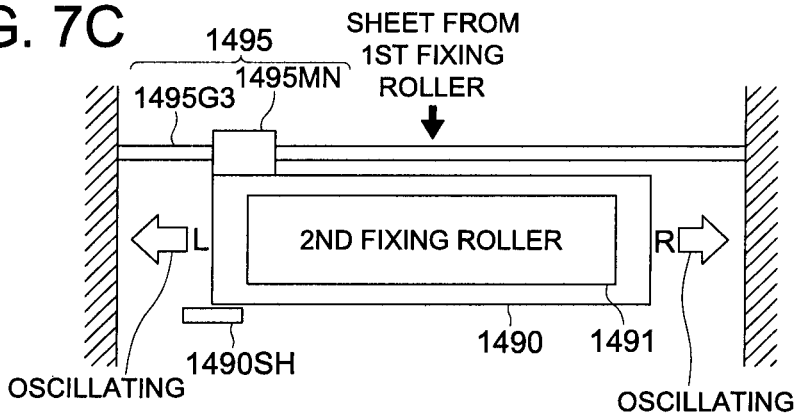

Referring to FIGS. 7A through 7C, the following describes the fixing roller surface roughness prevention mechanism of the first fixing device 1480 and second fixing device 1490.

As shown in FIG. 7A, a polishing section 1485 composed of various types of polishing means such as a polishing sheet or polishing roller is provided as a first fixing roller surface roughness prevention mechanism, close to the surface of the first fixing roller 1481 of the first fixing device 1480. Under the control of the print control section 141, this polishing section 1485 performs polishing operations in contact with the first fixing roller 1481, and retracts to a prescribed standby position. The surface of the first fixing roller is polished by the polishing section 1485 to ensure that the surface will not be roughened by the scratches or abrasions caused by the edge of the recording sheet.

As shown in FIG. 7A, in the vicinity of the second fixing roller 1491 of the second fixing device 1490, an oscillating section 1495 is provided as a second fixing roller surface roughness prevention mechanism. The entire second fixing device 1490 or the second fixing roller 1491 can be oscillated in the axial direction of the second fixing roller 1491 by the oscillating section 1495. In FIG. 7A, the direction L or R corresponds to the axial direction of the second fixing roller 1491. When the second fixing roller 1491 is oscillated by the oscillating section 1495, the roughness resulting from scratches or abrasions caused by the edge of the recording sheet is diffused without being concentrated.

The first fixing device 1480 is a fixing device as a basis of the image forming apparatus 100, and is therefore characterized by a higher heat capacity and greater weight. Thus, in a fixing roller surface roughness prevention mechanism, polishing is more preferably used than oscillation. In the meantime, the second fixing device 1490 is an auxiliary fixing device located downstream in the direction of recording sheet conveyance in the first fixing device 1480. This allows the heat capacity to be smaller than that of the first fixing device 1480. Thus, the weight is smaller. Oscillation can be used preferably in a fixing roller surface roughness prevention mechanism.

[Structure of Fixing Roller Surface Roughness Prevention Mechanism of the Second Fixing Device 1490]

Referring to FIG. 7B, FIG. 7C, and FIGS. 8A through 8C, the following describes the details of the relationship between the second fixing roller 1491 and oscillating section 1495.

As shown in FIG. 7B and FIGS. 8A through 8C, the oscillating section 1495, for example, includes an oscillation motor 1495M with the one end thereof fixed to any of the sites (the hatched portion on the left end in FIG. 7B and FIGS. 8A through 8C) of the image forming apparatus 100, a gear 1495G1 driven by the oscillation motor 1495M and a gear 1495G2 arranged on the side of the second fixing device 1490.

This oscillating section 1495 ensures that the second fixing roller 1491 or the second fixing device 1490 as a whole configured to oscillate in the axial direction of the second fixing roller 1491 is oscillated in the axial direction by the drive force of the oscillation motor 1495M having been converted by the gears 1495G1 and 1495G2. For this oscillation, the second fixing roller 1491 or fixing device 1480 as a whole is retained by a sliding mechanism (not illustrated) and others.

As shown in FIG. 7C, the oscillating section 1495, for example, includes a threaded rod 1495G3 fixed to any of the sites (the hatched portion on the left end in FIG. 7C) of the image forming apparatus 100, a nut engaged with this threaded rod 1495G3 and driven by the motor (not illustrated) and, a drive section 1495MN mounted on the side of the second fixing roller 1491.

This oscillating section 1495 ensures that the second fixing roller 1491 or the second fixing device 1490 as a whole configured to oscillate in the axial direction of the second fixing roller 1491 is oscillated in a prescribed direction along the threaded rod 1495G3 by the rotation of the nut driven by the motor inside the drive section 1495MN.

A motor, gear, screw, and nut are shown to be included in the oscillating section 1495 of FIGS. 7A through 7C and FIGS. 8A through 8C. However, this oscillating section 1495 can be embodied in a great number of variations, for example, by using various types of oscillation means such as a voice coil motor, ultrasonic motor, linear motor, solenoid, or extra-magnetostrictive element.

The second fixing roller 1491 or the second fixing device 1490 as a whole is so configured that the position thereof at the time of oscillation can be detected by the oscillation sensor 1490SH. The result of detection is notified to the print control section 141, controller 101, or the second fixing controller 151.

Figure 8A:
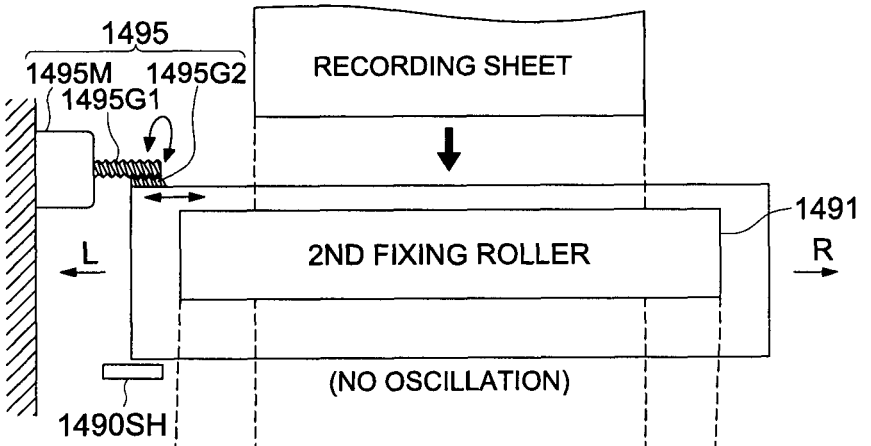
FIGS. 8A through 8C are explanatory diagrams showing the state of a fixing device in an embodiment of the present invention.
Figure 8B:
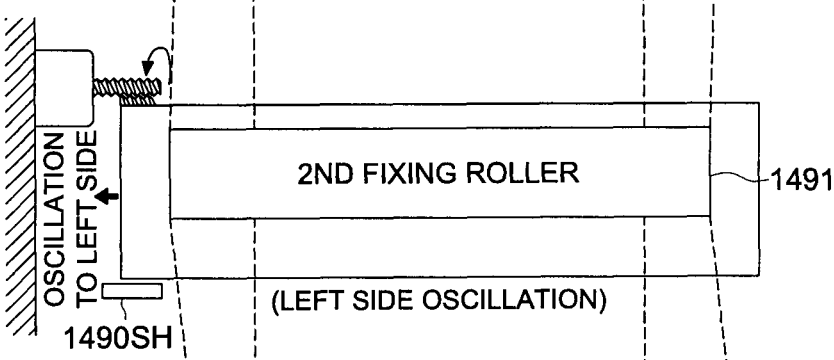
Figure 8C:
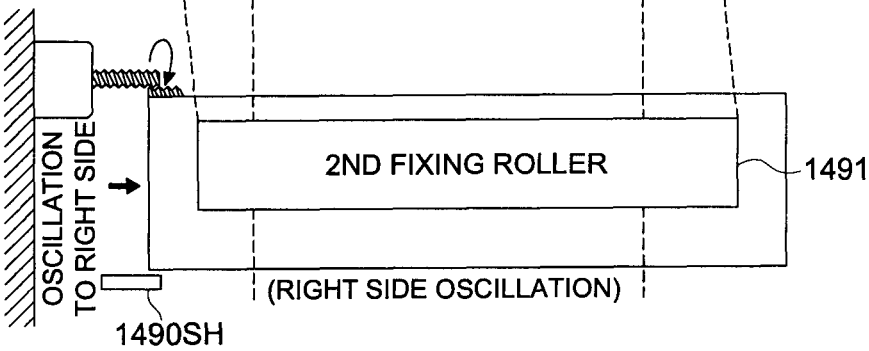

FIG. 8A shows that the second fixing roller 1491 is located at the central position in the presence or absence of oscillation. FIG. 8B shows that the second fixing roller 1491 is located at the left side of the central position in the presence of oscillation. FIG. 8C shows that the second fixing roller 1491 is located at the right side of the central position in the presence of oscillation. The amplitude of the oscillation in this case is intended to avoid roughness produced on the surface of the second fixing roller 1491 by the edge of the recording sheet The amplitude is sufficient if it is in the range from several millimeters through several tens of millimeters.

[Operation]

Figure 9:
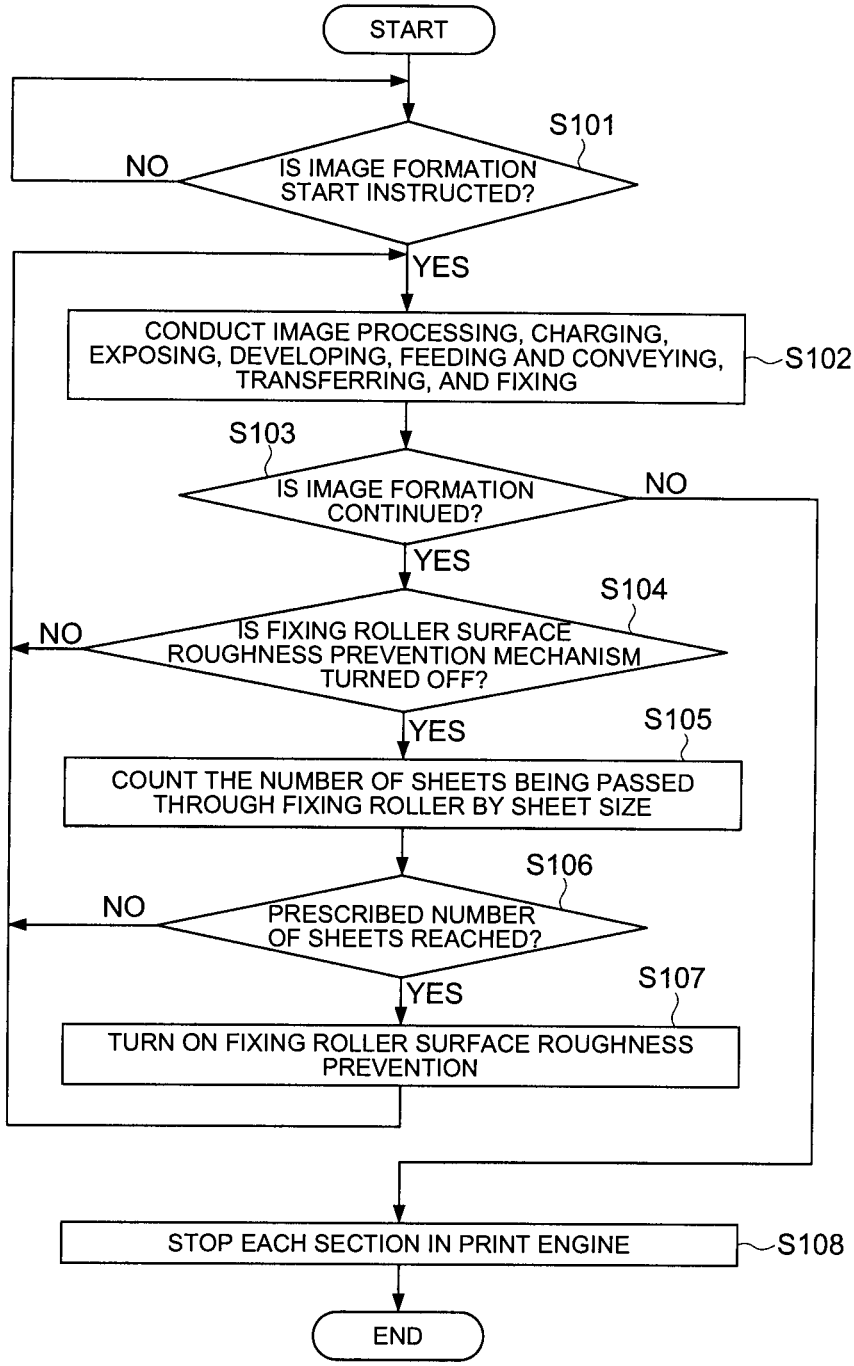
FIG. 9 is a flowchart representing the operation of an embodiment of the present invention.

Referring to the flow chart of FIG. 9, the following describes the operations of the image forming apparatus, image fixing device, and image forming system of the present embodiment In the first place, if an image formation output instruction is given from the operation and display section 105 or an external PC which is not illustrated (YES in Step S101 of FIG. 9), the controller 101 having received this instruction controls the image processing section 130 and print engine 140 to form an image according to the specified image data. In this case, the print control section 141 having received an instruction from the controller 101 controls various sections of the print engine 140 to perform the operations of charging, exposure, development, sheet conveyance, transfer, and fixing (Step S102 of FIG. 4). In this case, processing starts in the initial state, with the fixing roller surface roughness prevention function turned off.

When image formation is to continue (YES in Step S103 of FIG. 4), the controller 101 checks if the fixing roller surface roughness prevention mechanism is turned on or not (Step S104 of FIG. 9). If it is already turned on (NO in Step S104 of FIG. 9), the system goes back to Step S102, and repeats the aforementioned image formation processing (Step S102 through Step S104) until termination of the image formation (Step S103 of FIG. 4).

In this case, if the fixing roller surface roughness prevention mechanism is off (YES in Step S104 of FIG. 9), the controller 101 counts the sheets having passed through the first fixing roller 1481 and sheets having passed through the second fixing roller 1491, for each size of recording sheets (Step S105 of FIG. 9). When there may be a difference between the number of the sheets having passed through the first fixing roller 1481 and that of the sheets having passed through the second fixing roller 1491 as in the case of FIG. 5, these counting operations are performed independently of each other.

If the number of the recording sheets of any size having passed through the roller has not reached a prescribed number of sheets in the image formation operation (NO in Step S106 of FIG. 9), the system goes back to Step S102, and repeats the aforementioned image formation processing (Step S102 through Step S106) until termination of the image formation (Step S103 of FIG. 4).

"A prescribed number of sheets" in the sense in which it is used here refers to the number of recording sheets or the number slightly smaller determined in advance wherein the edges of these recording sheets of a particular size are brought in contact with one and the same position of the fixing roller surface by the repeated operation of image formation using these recording sheets, with the result that the surface of the fixing roller is likely to be subjected to scratches or abrasions.

If, in the process of image formation, the number of the recording sheets of any size having passed has reached a prescribed number of sheets (YES in Step S106 of FIG. 9) in any one of the first fixing roller 1481 and second fixing roller 1491, the controller 101 gives an instruction to the print control section 141 (Step S107 of FIG. 9) to turn on the fixing roller surface roughness prevention function for the fixing roller wherein the prescribed number of sheets has been reached.

When the fixing roller surface roughness prevention function is turned on for the first fixing roller 1481, the print control section 141 ensures that the polishing section 1485 having been kept in the standby position is brought in contact with the surface of the first fixing roller 1481, and the surface of the first fixing roller 1481 is polished by the polishing section 1485 so that the surface will not be roughened by scratches or abrasions caused by the side edges of the recording sheet.

When the fixing roller surface roughness prevention function is turned on for the second fixing roller 1491, the print control section 141 ensures that the second fixing device 1490 as a whole or the second fixing roller 1491 is oscillated by the oscillating section 1495 so that the roughness resulting from scratches or abrasions caused by the side edges of the recording sheet will be diffused on the surface of the second fixing roller 1491, without being concentrated on a particular position. The amplitude of the oscillation in this case is intended to avoid roughness produced on the surface of the second fixing roller 1491 by the edge of the recording sheet Thus, the oscillation is controlled at the cycle wherein there is movement of about several millimeters through several tens of millimeters during the operation of fixing several tens of sheets through a few hundred sheets.

When the second fixing device 150 is an external device of the image forming apparatus 100, and an image forming system is formed of these devices as a whole without the presence of a second fixing controller 151, an instruction of oscillation can be issued directly to the oscillating section 1495' under the control of the controller 101 or print control section 141.

In the image forming system, when the external second fixing device 150 is equipped with the second fixing controller 151, an instruction of oscillation can be issued to the oscillating section 1495' from the controller 101 or print control section 141 through the second fixing controller 151.

After the fixing roller surface roughness prevention function has been turned on as described above, the controller 101 goes back to Step S102, and repeats the aforementioned image formation processing (Step S102 through Step S104) until termination of the image formation (Step S103 of FIG. 4).

When an instruction to terminate the image formation output has been issued from the operation and display section 105 or an external PC which id not illustrated (NO in Step S103 of FIG. 9), or when image formation output according to the specified image data has been terminated (NO in Step S103 of FIG. 9), the controller 101 provides control to stop each section of the image processing section 130 and print engine 140 (Step S108 of FIG. 4), and terminates the processing.

In the manner described above, when a prescribed number of the recording sheets having the same size in the image forming operation has been reached for each of the first fixing roller 1481 and second fixing roller 1491, the fixing roller surface roughness prevention mechanism is operated. This arrangement ensures effective prevention of the roughness on the surface of the fixing roller of the fixing devices, when fixing is performed by two fixing devices of the first and second fixing devices.

[Fixing Roller Layout Example]

FIGS. 10A through 10C are the schematic diagrams showing the layout examples of the first fixing roller 1481 and polishing section 1485, as viewed from the direction of the cross section. In this case, the first fixing roller 1481 at least provides the first fixing operation wherein heat is applied to the single surface with a toner image formed thereon.

In the configuration of FIG. 10A, the first fixing roller 1481 performs the first fixing operation wherein the recording sheets are conveyed as they are sandwiched between a heating roller 1481*h* with a built-in heater and a pressure roller 1481*p*. In this case, the surface of the heating roller 1481*h* is polished by the polishing section 1485.

In the configuration of FIG. 10B, the first fixing roller 1481 performs the first fixing operation wherein the recording sheets are conveyed as they are sandwiched between a heating belt 1481*hb* driven by a heating roller 1481*h* with a built-in heater and a belt driver roller 1481*c*, and a pressure roller 1481*p*. In this case, the surface of the heating belt 1481*hb* is polished by the polishing section 1485.

In the configuration of FIG. 10C, the first fixing roller 1481 performs the first fixing operation wherein the recording sheets are conveyed as they are sandwiched between a heating roller 1481*h* with a built-in heater, and a pressure belt 1481*pb* driven by the pressure roller 1481*p*1 and drive roller 1481*p*2. In this case, the surface of the heating roller 1481*h* is polished by the polishing section 1485.

FIGS. 10D through 10G are schematic diagrams showing the layout example of the second fixing roller 1491, as viewed from the direction of the cross section. In this case, the second fixing roller 1491 shown here performs the second fixing operation by applying heat to both surfaces, although heat may be applied to only one surface. In the case of the second fixing roller 1491, the heating roller as a whole, or the heating roller and heating belt as a whole are preferably oscillated It is sufficient that at least the roller or belt in contact with the recording sheet is oscillated.

In the configuration of FIG. 10D, the second fixing roller 1491 performs the second fixing operation wherein recording sheets are conveyed as they are sandwiched between a heating roller 1491*h*1 with a built-in heater and a heating roller 1491*h*2 with a built-in heater.

In the configuration of FIG. 10E, the second fixing roller 1491 performs the second fixing operation wherein recording sheets are conveyed as they are sandwiched between, a heating belt 1491*hb* driven by a heating roller 1491*h*11 with a built-in heater and a belt driver roller 1491*h*12, and a heating roller 1491*h*2 with a built-in heater.

In the configuration of FIG. 10F, the second fixing roller 1491 performs the second fixing operation wherein recording sheets are conveyed as they are sandwiched between a heating roller 1491*h*1 with a built-in heater, and a heating belt 1491*hb* driven by a heating roller 1491*h*22 with a built-in heater and belt driver roller 1491*h*21.

In the configuration of FIG. 10G the second fixing roller 1491 performs the second fixing operation wherein recording sheets are conveyed as they are sandwiched between a heating belt 1491*h*b driven by the heating roller 1491*h*11 with a built-in heater and a belt driver roller 1491*h*12, and a heating belt 1491*hb* driven by the heating roller 1491*h*22 with a built-in heater and belt driver roller 1491*h*21. The polishing section 1485 can be provided on the side of the pressure roller 1481P.

[Another Embodiment (1)]

The above description of the embodiment assumes that both the first fixing roller 1481 and second fixing roller 1491 are used for fixing roller surface roughness prevention. It has become possible to provide an image forming apparatus, image fixing device, and image forming system wherein roughness on the surface of the second fixing roller can be effectively prevented by the fixing roller surface roughness prevention function applied to at least the second fixing roller 1491. This arrangement has never been achieved in the related art.

[Another Embodiment (2)]

In the above description of the embodiment, the oscillating section 1495 is turned off (wherein oscillation does not occur) or is turned on (wherein oscillation occurs). However, the present invention is not restricted thereto.

The range of oscillation can be expanded stepwise. For example, when a first prescribed number of recording sheets have passed, oscillation is turned on in the first phase. After that, when a second prescribed number of recording sheets has passed, oscillation is turned on in the second phase wherein the oscillation amplitude is expanded. This arrangement permits an effective and proper diffusion and elimination of the roughness on the surface of the fixing roller surface, even when a great number of sheets have passed.

[Another Embodiment (3)]

In the aforementioned embodiments, a specific configuration was represented by the four-color image forming apparatus of FIG. 3. This present embodiment is also applicable to other apparatuses such as a monochromatic image forming apparatus or an image forming apparatus using five or more colors.

The embodiments of the image forming apparatus, image fixing device, and image forming system of the present invention are provided with a fixing roller surface roughness prevention mechanism that prevents the roughness from being formed on the surface of the fixing roller due to the contact of the fixing roller with the side edges of the recording sheet. When a prescribed number of the recording sheets having the same size in the image forming operation have been reached, the fixing roller surface roughness prevention mechanism is turned on. This arrangement provides effective prevention of roughness from occurring on the surface of the fixing roller of a fixing device, when fixing operation is performed by two fixing devices, the first and second fixing devices.

What is claimed is:

1. An image forming apparatus comprising:

(a) an image forming section which transfers a toner image in accordance with image data onto a recording sheet;

(b) a first fixing device having a first fixing roller, which fixes the toner image onto the recording sheet with heat;

(c) a second fixing device having a second fixing roller, which further applies heat to the recording sheet that has been fixed by the first fixing device;

(d) a second fixing roller surface roughness prevention mechanism which prevents a roughness on a surface of the second fixing roller that has been generated due to side ends of the recording sheet being brought into contact with the surface of the second fixing roller; and (e) a controller which controls the image forming section, the first and second fixing devices and the second fixing roller surface roughness prevention mechanism, and further comprising a polishing member as a first fixing roller surface roughness prevention mechanism, which prevents a roughness generated on a surface of the first fixing roller due to the side ends of the recording sheet being brought into contact with the surface thereof, by polishing the surface, wherein the second fixing roller surface roughness prevention mechanism is an oscillating section which oscillates the second fixing roller in a direction of a rotational axis, wherein the controller controls the polishing member to prevent the roughness on the surface of the first fixing roller by polishing the surface thereof, and controls the oscillating section to prevent the roughness on the surface of the second fixing roller by dispersing the roughness on the surface thereof, and wherein the controller counts the number of recording sheets which have passed through the first fixing roller and the number of recording sheets which have passed through the second fixing roller, independently, for each size of recording sheet, and when the number of the recording sheets of any size having passed has reached a prescribed number of sheets, the controller operates the fixing roller surface roughness prevention mechanism for the fixing roller wherein the prescribed number of sheets has been reached.

2. A fixing apparatus which is attached to an image forming apparatus, comprising:

(a) an image forming section which transfers a toner image in accordance with image data onto a recording sheet;

(b) a first fixing device having a first fixing roller, which fixes the toner image onto the recording sheet with heat;

(c) a second fixing device having a second fixing roller, which further applies heat to the recording sheet that has been fixed by the first fixing device; and (d) a second fixing roller surface roughness prevention mechanism which prevents a roughness on a surface of the second fixing roller that has been generated due to side ends of the recording sheet being brought into contact with the surface of the second fixing roller, further comprising a controller which controls the second fixing roller surface roughness prevention mechanism to operate, when image formation to the same sized recording sheets reaches a prescribed number, wherein the second fixing roller surface roughness prevention mechanism is an oscillating section which oscillates the second fixing roller in a direction of a rotational axis thereof, and further comprising a controller which controls the oscillating section to oscillate the second fixing roller, thereby preventing the roughness through dispersing the roughness on the surface of the second fixing roller, wherein the oscillating section comprises an oscillation motor one end of which is fixed on the image forming apparatus, a first gear which is driven by the oscillation motor, and a second gear provided on a side of the second fixing device, and the oscillating section oscillates, in a prescribed direction, the second fixing roller which is oscillatably arranged in a direction of a rotational axis of the second fixing roller, or an entirety of the second fixing device by a driving force of the oscillation motor that is converted through the first and second gears, and wherein the oscillating section conducts an oscillation having a prescribed amplitude when a first prescribed number of recording sheets have passed through the second fixing roller, and further conducts an oscillation having amplitude wider than the prescribed amplitude when a second prescribed number of recording sheets have passed through the second fixing roller.

3. An image forming system comprising:

(a) an image forming apparatus comprising (1) an image forming section which transfers a toner image in accordance with image data onto a recording sheet, and (2) a first fixing device having a first fixing roller, which fixes the toner image onto the recording sheet with heat; and (b) a second fixing device having a second fixing roller, which further applies heat to the recording sheet that has been fixed by the first fixing device, wherein the second fixing device comprises a second fixing roller surface roughness prevention mechanism which prevents a roughness on a surface of the second fixing roller that has been generated due to side ends of the recording sheet being brought into contact with the surface of the second fixing roller, wherein the image forming apparatus comprises a polishing member as a first fixing roller surface roughness prevention mechanism, which prevents a roughness generated on a surface of the first fixing roller due to the side ends of the recording sheet being brought into contact with the surface thereof, by polishing the surface, wherein the second fixing roller surface roughness prevention mechanism is an oscillating section which oscillates the second fixing roller in a direction of a rotational axis, further comprising a controller which controls the polishing member to prevent the roughness on the surface of the first fixing roller by polishing the surface thereof, and controls the oscillating section to prevent the roughness on the surface of the second fixing roller by dispersing the roughness on the surface thereof, when image formation to the same sized recording sheets reaches a prescribed number, wherein the controller counts the number of recording sheets which have passed through the first fixing roller and the number of recording sheets which have passed through the second fixing roller, independently, for each size of recording sheet, and when the number of the recording sheets of any size having passed has reached a prescribed number of sheets, the controller operates the fixing roller surface roughness prevention mechanism for the fixing roller wherein the prescribed number of sheets has been reached.

4. An image forming apparatus comprising:

(a) an image forming section which transfers a toner image in accordance with image data onto a recording sheet;

(b) a first fixing device having a first fixing roller, which fixes the toner image onto the recording sheet with heat;

(c) a second fixing device having a second fixing roller, which further applies heat to the recording sheet that has been fixed by the first fixing device;

(d) a second fixing roller surface roughness prevention mechanism which prevents a roughness on a surface of the second fixing roller that has been generated due to side ends of the recording sheet being brought into contact with the surface of the second fixing roller; and a controller which controls the image forming section, the first and second fixing devices and the second fixing roller surface roughness prevention mechanism, and further comprising a polishing member as a first fixing roller surface roughness prevention mechanism, which prevents a roughness generated on a surface of the first fixing roller due to the side ends of the recording sheet being brought into contact with the surface thereof, by polishing the surface, wherein the second fixing roller surface roughness prevention mechanism is an oscillating section which oscillates the second fixing roller in a direction of a rotational axis, wherein the controller controls the polishing member to prevent the roughness on the surface of the first fixing roller by polishing the surface thereof, and controls the oscillating section to prevent the roughness on the surface of the second fixing roller by dispersing the roughness on the surface thereof, wherein the controller counts the number of recording sheets which have passed through the first fixing roller and the number of recording sheets which have passed through the second fixing roller, independently, for each size of recording sheet, and when the number of the recording sheets of any size having passed has reached a prescribed number of sheets, the controller operates the fixing roller surface roughness prevention mechanism for the fixing roller wherein the prescribed number of sheets has been reached, wherein the oscillating section comprises an oscillation motor one end of which is fixed on the image forming apparatus, a first gear which is driven by the oscillation motor, and a second gear provided on a side of the second fixing device, and the oscillating section oscillates, in a prescribed direction, the second fixing roller which is oscillatably arranged in a direction of a rotational axis of the second fixing roller, or an entirety of the second fixing device by a driving force of the oscillation motor that is converted through the first and second gears, and wherein the oscillating section conducts an oscillation having a prescribed amplitude when a first prescribed number of recording sheets have passed through the second fixing roller, and further conducts an oscillation having amplitude wider than the prescribed amplitude when a second prescribed number of recording sheets have passed through the second fixing roller.

5. An image forming system comprising:

(a) an image forming apparatus comprising (1) an image forming section which transfers a toner image in accordance with image data onto a recording sheet, and (2) a first fixing device having a first fixing roller, which fixes the toner image onto the recording sheet with heat; and (b) a second fixing device having a second fixing roller, which further applies heat to the recording sheet that has been fixed by the first fixing device, wherein the second fixing device comprises a second fixing roller surface roughness prevention mechanism which prevents a roughness on a surface of the second fixing roller that has been generated due to side ends of the recording sheet being brought into contact with the surface of the second fixing roller, wherein the image forming apparatus comprises a polishing member as a first fixing roller surface roughness prevention mechanism, which prevents a roughness generated on a surface of the first fixing roller due to the side ends of the recording sheet being brought into contact with the surface thereof, by polishing the surface, wherein the second fixing roller surface roughness prevention mechanism is an oscillating section which oscillates the second fixing roller in a direction of a rotational axis, further comprising a controller which controls the polishing member to prevent the roughness on the surface of the first fixing roller by polishing the surface thereof, and controls the oscillating section to prevent the roughness on the surface of the second fixing roller by dispersing the roughness on the surface thereof, when image formation to the same sized recording sheets reaches a prescribed number, wherein the controller counts the number of recording sheets which have passed through the first fixing roller and the number of recording sheets which have passed through the second fixing roller, independently, for each size of recording sheet, and when the number of the recording sheets of any size having passed has reached a prescribed number of sheets, the controller operates the fixing roller surface roughness prevention mechanism for the fixing roller wherein the prescribed number of sheets has been reached, wherein the oscillating section comprises an oscillation motor one end of which is fixed on the image forming apparatus, a first gear which is driven by the oscillation motor, and a second gear provided on a side of the second fixing device, and the oscillating section oscillates, in a prescribed direction, the second fixing roller which is oscillatably arranged in a direction of a rotational axis of the second fixing roller, or an entirety of the second fixing device by a driving force of the oscillation motor that is converted through the first and second gears, and wherein the oscillating section conducts an oscillation having a prescribed amplitude when a first prescribed number of recording sheets have passed through the second fixing roller, and further conducts an oscillation having amplitude wider than the prescribed amplitude when a second prescribed number of recording sheets have passed through the second fixing roller.

6. The fixing apparatus of claim 2, wherein the oscillating section comprises a threaded rod which is fixed on the image forming apparatus, a nut which is engaged with the threaded rod and rotated by a motor and a driving section which is provided on the second fixing roller, and the oscillating section oscillates, in a prescribed direction, the second fixing roller which is oscillatably arranged in a direction of the rotational axis of the second fixing roller, or an entirety of the second fixing device by a rotation of the nut which is driven by the motor provided inside the driving section along the threaded rod.

7. The fixing apparatus of claim 2, wherein the second fixing roller is oscillated in a prescribed direction from a center position in the rotational axis or in a direction reverse to the prescribed direction by a prescribed amplitude according to an oscillation operation by the oscillating section.

8. The image forming apparatus of claim 4, wherein the oscillating section comprises a threaded rod which is fixed on the image forming apparatus, a nut which is engaged with the threaded rod and rotated by a motor and a driving section which is provided on the second fixing roller, and the oscillating section oscillates, in a prescribed direction, the second fixing roller which is oscillatably arranged in a direction of the rotational axis of the second fixing roller, or an entirety of the second fixing device by a rotation of the nut which is driven by the motor provided inside the driving section along the threaded rod.

9. The image forming apparatus of claim 4, wherein the second fixing roller is oscillated in a prescribed direction from a center position in the rotational axis or in a direction reverse to the prescribed direction by a prescribed amplitude according to an oscillation operation by the oscillating section.

10. The image forming system of claim 5, wherein the oscillating section comprises a threaded rod which is fixed on the image forming apparatus, a nut which is engaged with the threaded rod and rotated by a motor and a driving section which is provided on the second fixing roller, and the oscillating section oscillates, in a prescribed direction, the second fixing roller which is oscillatably arranged in a direction of the rotational axis of the second fixing roller, or an entirety of the second fixing device by a rotation of the nut which is driven by the motor provided inside the driving section along the threaded rod.

11. The image forming system of claim 5, wherein the second fixing roller is oscillated in a prescribed direction from a center position in the rotational axis or in a direction reverse to the prescribed direction by a prescribed amplitude according to an oscillation operation by the oscillating section.

* * * * *